US008814617B2

(12) United States Patent
Marholm et al.

(10) Patent No.: US 8,814,617 B2
(45) Date of Patent: Aug. 26, 2014

(54) THRUSTER UNIT AND METHOD FOR INSTALLATION OF A THRUSTER UNIT

(75) Inventors: Ole Arnt Marholm, Eidsa (NO); Gunnar Johnsen, Ulsteinvik (NO); Dag Brandal, Ulsteinvik (NO)

(73) Assignee: Rolls-Royce Marine AS, Ulsteinvik (NO)

( * ) Notice: Subject to any disclaimer, the term of this patent is extended or adjusted under 35 U.S.C. 154(b) by 286 days.

(21) Appl. No.: 13/511,871

(22) PCT Filed: Nov. 25, 2010

(86) PCT No.: PCT/NO2010/000435

§ 371 (c)(1),
(2), (4) Date: Oct. 30, 2012

(87) PCT Pub. No.: WO2011/074971

PCT Pub. Date: Jun. 23, 2011

(65) Prior Publication Data

US 2013/0040514 A1 Feb. 14, 2013

(30) Foreign Application Priority Data

Nov. 25, 2009 (NO) ..... 20093413

(51) Int. Cl.
*B63H 5/16* (2006.01)
*B63H 5/14* (2006.01)

(52) U.S. Cl.
CPC ..... *B63H 5/14* (2013.01)
USPC ..... 440/68; 114/151; 114/148; 310/114; 417/356

(58) Field of Classification Search
USPC ..... 114/148, 151; 440/68; 310/114; 417/356
See application file for complete search history.

(56) References Cited

U.S. PATENT DOCUMENTS 1,071,042 A * 8/1913 Fuller ..... 417/247
3,708,251 A * 1/1973 Pierro ..... 417/356

(Continued)

FOREIGN PATENT DOCUMENTS

| | | | |
|---|---|---|---|
| GB | 1 309 753 | A | 3/1973 |
| NO | 156892 | B | 7/1984 |
| NO | 840040 | A | 7/1984 |
| WO | 01/92101 | A1 | 12/2001 |
| WO | 2007/051678 | A1 | 5/2007 |
| WO | 2009/126097 | A1 | 10/2009 |

OTHER PUBLICATIONS

International Search Report from PCT/NO2010/000435 dated May 4, 2011 (2 pages).
Written Opinion from PCT/NO2010/000435 dated May 4, 2011 (8 pages).

(Continued)

*Primary Examiner* — Lars A Olson
*Assistant Examiner* — Jovon Hayes
(74) *Attorney, Agent, or Firm* — Osha Liang LLP

(57) ABSTRACT

In a thruster for a vessel including a hull, the thruster comprises at least one tunnel element and at least one thruster unit. The tunnel element includes at least a part of a through tunnel in the hull when arranged in the hull. The at least one thruster unit and the at least one tunnel element include cooperating fastening devices for detachably fixing the at least one thruster unit in the at least one tunnel element such that the at least one thruster unit is configured to be passed through the tunnel and mounted to the at least one tunnel element, or demounted from the at least one tunnel element and passed out of the tunnel. A method for mounting and demounting a thruster in a tunnel element includes a tunnel element arranged in the vessel of a hull.

17 Claims, 8 Drawing Sheets

(56) References Cited

U.S. PATENT DOCUMENTS

| | | | | |
|---|---|---|---|---|
| 4,459,087 | A * | 7/1984 | Barge | 417/356 |
| 4,505,684 | A * | 3/1985 | Holden et al. | 440/38 |
| 4,831,297 | A * | 5/1989 | Taylor et al. | 310/87 |
| 5,078,628 | A * | 1/1992 | Garis, Jr. | 440/6 |
| 5,252,875 | A * | 10/1993 | Veronesi et al. | 310/114 |
| 5,306,183 | A * | 4/1994 | Holt et al. | 440/6 |
| 6,325,683 | B1 | 12/2001 | Yocom | |
| 6,427,618 | B1 * | 8/2002 | Hilleman | 114/338 |
| 6,701,862 | B2 * | 3/2004 | Hilleman | 114/338 |
| 7,530,319 | B1 * | 5/2009 | Ha | 114/151 |
| 7,549,903 | B2 * | 6/2009 | Andersson | 440/68 |
| 8,299,669 | B2 * | 10/2012 | Gieras et al. | 310/87 |
| 2006/0063442 | A1 | 3/2006 | Taylor et al. | |
| 2012/0231682 | A1 * | 9/2012 | Roodenburg et al. | 440/54 |
| 2013/0040514 | A1 * | 2/2013 | Marholm et al. | 440/68 |

OTHER PUBLICATIONS

Response to International Search Report and Written Opinion dated May 4, 2011 filed with EPO on Oct. 25, 2011 (4 pages).

Second Written Opinion from PCT/NO2010/000435 dated Nov. 30, 2011 (7 pages).

Response to Second Written Opinion dated Nov. 30, 2011 filed with EPO on Jan. 30, 2012 (3 pages).

International Preliminary Report on Patentability from PCT/NO2010/000435 dated Feb. 21, 2012 (6 pages).

File stamped copy from EPO dated Feb. 16, 2012 of Response to Second Written Opinion dated Jan. 30, 2012 (14 pages).

espacenet Abstract Publication NO840040A dated Jul. 9, 1984 (1 page).

Norwegian Search Report dated Jun. 25, 2010 from Patent 20093413 (1 page).

* cited by examiner

A-A

THRUSTER UNIT AND METHOD FOR INSTALLATION OF A THRUSTER UNIT

CROSS-REFERENCE TO RELATED APPLICATIONS

This application is a national stage application of PCT/NO2010/000435, filed on Nov. 25, 2010, entitled "Thruster Unit and Method for Installation of a Thruster Unit," which claims priority to Norweigan Patent Application No. 20093413, filed on Nov. 25, 2009. Both PCT/NO2010/000435 and Norweigan Patent Application No. 20093413 are incorporated by reference herein in their entireties.

FIELD OF THE INVENTION

One or more embodiments of the present invention is related to a thruster for installation in the hull of a vessel, where the thruster comprises a tunnel element and at least one thruster unit, and where the tunnel element, when arranged in the hull, at least constitutes a part of the through tunnel in the vessel's hull. The present invention also relates to a method for mounting and demounting a thruster unit which is a part of the thruster on a vessel, where the thruster comprises at least one thruster unit and at least one tunnel element, and where the vessel comprises a hull through which the tunnel element is arranged.

BACKGROUND

In thrusters of this kind, usually in the form of a propeller device arranged in a tunnel in the vessel's hull, the propeller device or devices are, in accordance with the current state of the art, mounted when the vessel is built. In these known propeller devices, which are based on oil-lubricated bearings and gearwheels, it is not possible to remove the propeller device for service, repair or to replace the propeller device, should this be necessary, without going into dock. In such cases, major work must usually be carried out on the vessel's hull in order to be able to remove the propeller device, and this is time-consuming and costly.

SUMMARY OF THE INVENTION

The present invention provides a thruster unit which allows a simple mounting and demounting of the thruster unit, where the mounting and demounting of the thruster unit can be carried out without the vessel going into dock.

In accordance with one or more embodiments, this is achieved according to the invention as it is defined in the attached independent claims. Additional embodiments of the invention are disclosed in the respective dependent claims.

A thruster is provided for generating a thrust on a vessel equipped with a hull, the thruster comprising at least one tunnel element and at least one thruster unit. The tunnel element, when arranged in the hull, constitutes at least a part of a through tunnel in the hull. Furthermore, the at least one thruster unit and the at least one tunnel element are constructed with cooperating fastening devices for detachably fixing the at least one thruster unit in the at least one tunnel element such that the at least one thruster unit can be passed in through the tunnel and mounted to the at least one tunnel element or demounted from the at least one tunnel element and passed out of the tunnel.

The axial extent of the tunnel will naturally vary depending on the design of the vessel's hull and where in the hull the tunnel is arranged. It will therefore be possible that the thruster unit has an axial extent which is essentially the same as the axial extent of the tunnel and that the thruster unit has an axial extent that constitutes a greater or smaller part of the axial extent of the tunnel.

When the tunnel element constitutes a part of the total extent of the tunnel in an axial direction, the tunnel element can be attached to the tunnel or otherwise to the hull with the aid of suitable fastening means such as bolts or screws. Alternatively, the tunnel element can be attached more permanently to the tunnel or otherwise to the hull by, for instance, welding.

It is possible to arrange one or more tunnel elements in the tunnel. For example, a tunnel element may be arranged in each end of the tunnel.

In one or more embodiments of the invention, the thruster unit comprises a first fastening device whilst the tunnel element comprises a second fastening device, the first and the second fastening devices being complementarily designed so as to enable the thruster unit and the tunnel element to be assembled.

The thruster further comprises one or more fastening means for mounting the first fastening device to the complementarily configured second fastening device. Such fastening means may, for example, comprise screws, bolts or other suitable fastening means which are so designed that they can be fastened and released relatively easily for mounting and demounting the thruster unit.

In one or more embodiments of the invention, the first fastening device comprises a bracket that is attached to the thruster unit, which bracket is constructed with a projecting fastening member. The second fastening device comprises a cavity arranged in the tunnel element, such as in a flange or in a ring in the tunnel element. The projecting fastening member and the cavity may be complementarily configured, i.e., that the projecting fastening member has a shape matching the shape of the cavity. For example, the projecting fastening member and the cavity may be cylindrically shaped with respective circular cross-sections when the sections are taken perpendicular to the axial longitudinal axis of the cavity and the projecting fastening member. The thruster unit and the tunnel element are provided with at least one, but may be a plurality of such pairs of complementarily shaped brackets and cavities.

It is of course possible to switch the positioning of the brackets and the cavities so that the brackets with their projecting fastening members, and the complementarily shaped cavities are arranged respectively on the tunnel element and in the thruster unit.

In one or more embodiments of the invention, the cavities are provided with an annular support element. When the thrust unit is mounted in the tunnel, the annular support element will lie between the inside of the cavity and the projecting fastening member. In a further embodiment of the invention, the annular support element is configured with variable stiffness in the axial longitudinal direction of the annular support element and/or in the radial direction of the annular support element.

In one or more embodiments of the invention, the first fastening device comprises a first fastening face whilst the second fastening device comprises a second fastening face, the fastening faces being complementarily shaped such that the first fastening face can be brought to bear against the second fastening face. A possible embodiment may be that one of the fastening means comprises a flange whilst the complementarily shaped fastening means comprises a face against which the flange can bear. In a further embodiment, both fastening means comprise respective faces which are formed on respectively the thruster unit and the tunnel element, where the complementary faces can be brought into contact with each other for assembly of the thruster unit and tunnel element. The said faces may, for example, be in the form of a shoulder when they are not faces of a flange.

As a result of the fact that the thruster unit can be passed in through the tunnel and mounted, and in the same way demounted and removed from the tunnel, the thruster unit will be capable of being mounted and demounted from the vessel without the vessel having to go into dock.

The thruster unit, in an embodiment of the invention, may be constructed in such a way that it comprises a propeller and a propeller ring surrounding the propeller, where the outer edge of the propeller blades which lie farthest from the rotational axis of the propeller are fastened to the inside of the propeller ring. The first fastening device may then be arranged on the propeller ring.

Furthermore, in this embodiment of the invention there may be provided a rotatable tunnel ring in the tunnel element. The second fastening means may then be arranged on the tunnel ring.

In one or more embodiments, the thruster unit with a propeller ring may comprises an inner ring and an outer ring, where the inner ring is arranged, with the aid of necessary bearings, so as to be able to rotate relative to the outer ring. The thruster's first fastening means is then arranged on the outer ring so that it can be mounted to the tunnel element. The bearings may be conventional bearings or magnetic bearings, or optionally a combination of conventional and magnetic bearings.

Cooperating drive means for rotation of the thruster unit's propeller are arranged on the thruster unit and in the tunnel element. Such drive means may, for example, consist of electromagnetic means.

More specifically, the drive means for driving the propeller may comprise magnets and windings which are arranged respectively in the rotating part of the thruster unit and in the stationary part of the tunnel element or vice versa, such that the rotating part of the thruster unit functions as rotor and the tunnel element as stator in an electromotor. Other alternatives are also conceivable; it would, for example be possible to use a system of gearwheel transmission of driving power to the rotor.

The rotating part of the thruster may be supported by means of a standard bearing which will be well-known to a person of skill in the art. It is also conceivable that the rotating part of the thruster may be supported by means of an electromagnetic bearing. It will then be possible to combine the electromagnetic bearing with the drive means in the same unit.

According to one or more embodiments of the present invention, there is further provided a tunnel inlet for a tunnel element which is arranged in the hull of a vessel, the tunnel inlet comprising an interior that faces towards the longitudinal centre axis of the tunnel inlet and an exterior that faces away from the centre axis of the tunnel inlet, and also an outer edge that faces out from the hull and an inner edge that faces in towards the vessel's hull. The tunnel inlet is demountably mounted to the tunnel element or directly on a thruster unit that is provided in the tunnel element, and the tunnel inlet has an internal diameter $d_1$ at its outer edge and an internal diameter $d_2$ at its inner edge, where $d_1$ is greater than $d_2$.

Furthermore, according to one or more embodiments of the present invention, there is provided a tunnel inlet for a tunnel in the hull of a vessel, which tunnel inlet comprises an inner wall that faces towards the longitudinal centre axis of the tunnel inlet and an outer wall that faces away from the centre axis of the tunnel inlet, and also an outer edge that faces out from the hull and an inner edge that faces in towards the vessel's hull, where the tunnel inlet is configured so as to be capable of being demountably attached to a tunnel element which, when mounted in the tunnel, at least constitutes a part of the tunnel, or so as to be capable of being arranged demountably on a thruster unit which is demountably arranged in the tunnel element, and that the tunnel inlet has an internal diameter $d_1$ at its outer edge and an internal diameter $d_2$ at its inner edge, where $d_1$ is greater than $d_2$, whereby an optimal flow pattern for water in and out of the tunnel can be obtained.

To obtain an optimal flow pattern through the tunnel inlet, the inner wall of the tunnel inlet between the outer edge and the inner edge is given a configuration which produces best possible hydrodynamic flow conditions through the tunnel inlet and into the tunnel element, and likewise when the water flows in the opposite direction out of the tunnel element and through the tunnel inlet. Such an optimal flow pattern for water flowing into the tunnel or out of the tunnel can be obtained if the inner wall of the tunnel inlet between the outer edge and the inner edge is given a curved configuration. The shape of the tunnel inlet's inner wall which provides the optimal flow conditions for water through a given tunnel inlet may quite easily be calculated by a skilled person in the field in each individual case with the aid of suitable computer programs. Computer programs for calculations of this type are freely commercially available.

In an embodiment of the tunnel inlet, a reinforcement is provided on the outside of the tunnel inlet which runs around the whole circumference of the tunnel inlet. The reinforcement is corrugated with wave crests where the thickness of the material of the tunnel inlet in a radial direction is greatest, but the reinforcements may of course be given other configurations. Another possibility will be, for example, to have a solid reinforcement around the whole circumference of the tunnel inlet.

If the tunnel inlet is constructed with corrugated reinforcements, an option will be to configure the ridge of the wave crests on the tunnel inlet's reinforcements so that they are essentially parallel to the longitudinal centre axis of the tunnel inlet. But of course it is also possible to configure the ridges of the reinforcements in such a way that they form an angle to the longitudinal centre axis of the tunnel inlet if so desired, for example, if constructional conditions call for such a configuration.

The wave crests of the corrugated reinforcements are provided with through holes for fastening means so as to enable the tunnel inlet to be mounted to the tunnel element and the thruster unit or optionally directly to the vessel's hull. The holes are arranged in such a way that they are essentially parallel to the centre axis of the tunnel inlet, but can of course be arranged so as to form an angle with the centre axis of the tunnel inlet if so desired, for example, for constructional reasons.

An alternative to using a separate tunnel inlet would be to form the side of the actual thruster unit which faces away from the tunnel with a configuration that provides optimal hydrodynamic flow conditions for water in and out of the thruster and the tunnel. This side of the thruster unit will thus form the inlet to the tunnel in which the thruster unit is arranged.

A method is also provided for mounting and demounting a thruster unit that is a part of a thruster on a vessel, the thruster comprising at least one thruster unit and at least one tunnel element. The vessel further comprises a hull with a through tunnel, where the tunnel element at least partly constitutes a part of the tunnel when the tunnel element is arranged in the hull. If a thruster unit is to be mounted to the tunnel element, the following steps are carried out:

- the thruster unit is passed essentially axially into the tunnel element from one of the tunnel element's openings and up to the point in the tunnel element where the thruster unit is to be mounted;
- the thruster unit is mounted to the tunnel element by means of cooperating fastening devices in the thruster unit and the tunnel element.

If a thruster unit, which is mounted in the tunnel element, is to be demounted, the following steps are carried out:

- the thruster unit is demounted from the tunnel element in that the cooperating fastening devices, which fasten to the thruster unit to the tunnel element, are demounted; and
- the thruster unit is passed essentially axially out of the tunnel unit through one of the tunnel element's openings.

In an embodiment of the invention, the thruster unit is provided with at least one first fastening device and the tunnel element with at least one second fastening device, where the at least one first fastening device and the at least one second fastening device are complementarily shaped fastening devices.

Alternatively, the first fastening device, as described above, may comprise a bracket that is constructed with a projecting fastening member, whilst the second fastening device may comprise a cavity having an inner wall, the projecting fastening member and the cavity being shaped complementarily. When the thruster unit is mounted in the tunnel element, an annular support element is provided in the cavity before the projecting fastening member is arranged in the annular support element. The thruster unit is subsequently passed in through the tunnel until it reaches the bracket, or the brackets, which are arranged in corresponding cavities in the tunnel element. The thruster unit is then fastened demountably to the brackets with the aid of suitable fastening means, as for instance bolts, screws or the like.

For this purpose, the bracket may be constructed with through holes for one or more bolts which can be screwed into matching threaded holes in the tunnel element.

The brackets can be fastened to the tunnel element, for example, with the aid of a sheet member which surrounds the projecting fastening member and has a radial extent that is greater than the diameter of the cavity or the cross-sectional area of the cavity if the cavity cross-section does not have a circular form. The sheet member can further be configured with holes for the passage of bolts, screws or the like that can be screwed into threaded holes in the tunnel element. When the sheet member is screwed to the tunnel element, the sheet member is arranged so as to clamp the projecting fastening member inside the cavity and holds it in place there.

In an embodiment of the invention, a tunnel inlet is mounted to the thruster unit or the tunnel element after the thruster unit has been introduced and is fixedly mounted to the fastening means of the tunnel unit. The tunnel inlet will be so configured that an optimally favourable flow regime is generated at the inlet or the outlet of the tunnel in the hull.

The thruster unit can thus easily be passed into the tunnel in the vessel's hull and mounted to the tunnel element, and optionally at a later time, easily demounted from the tunnel element and passed out of the tunnel in the vessel's hull.

Similarly, a tunnel inlet, which is optionally mounted on the thruster unit or the tunnel element, will be demounted before the thruster unit is demounted from the tunnel element and passed out of the tunnel element.

Other aspects of the invention will be apparent from the following description and the appended claims.

DETAILED DESCRIPTION OF THE INVENTION

Figure 1:
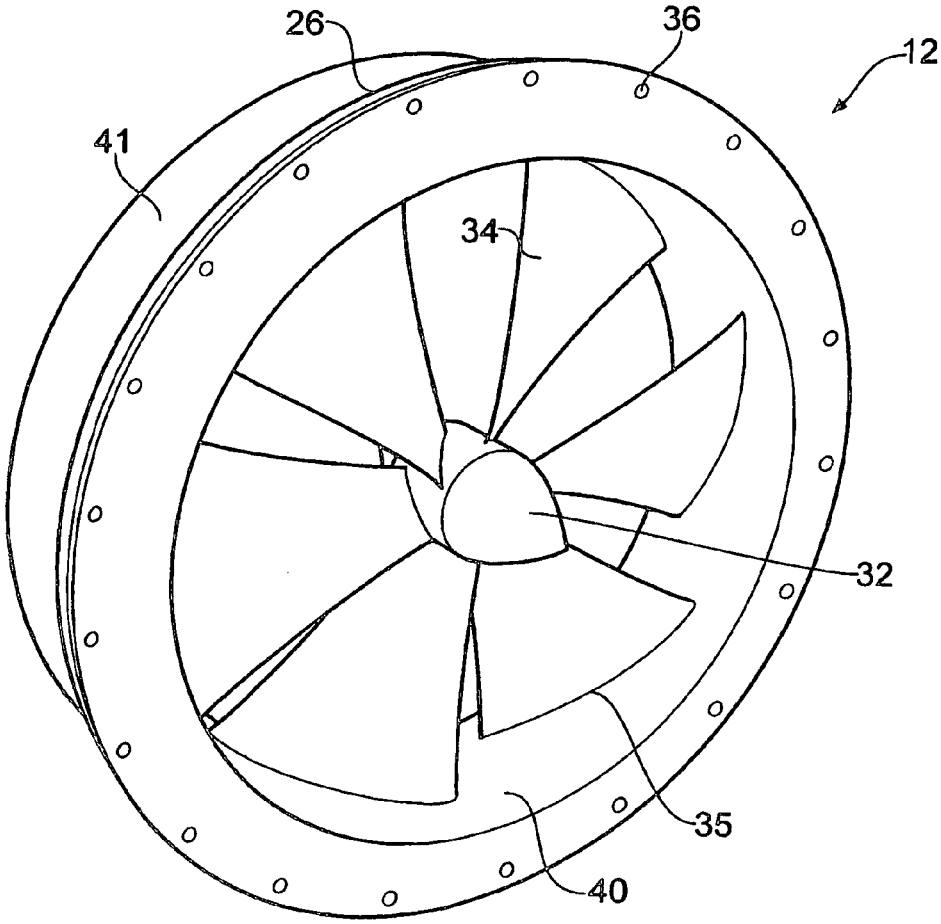
FIG. 1 is a perspective view of a thruster unit according to the invention.
Figure 2:
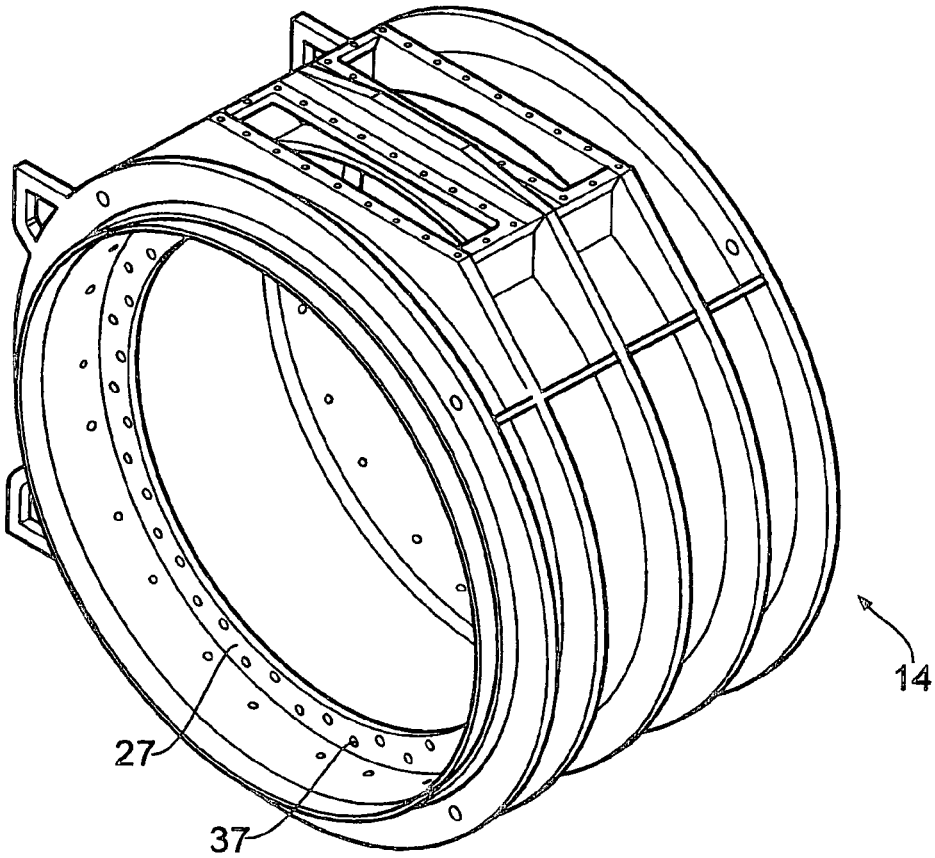
FIG. 2 is a perspective view of a tunnel element according to the invention.
Figure 3:
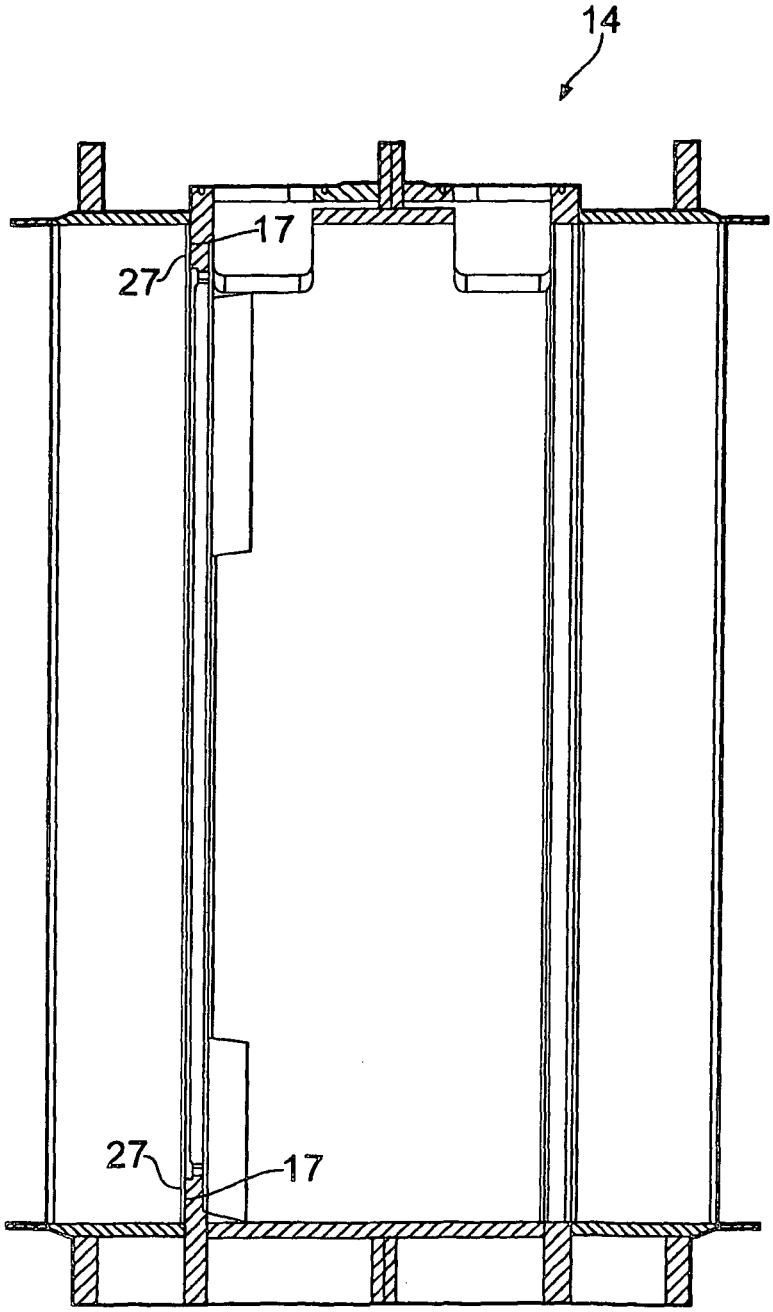
FIG. 3 shows a section A-A as indicated in FIG. 4.
Figure 4:
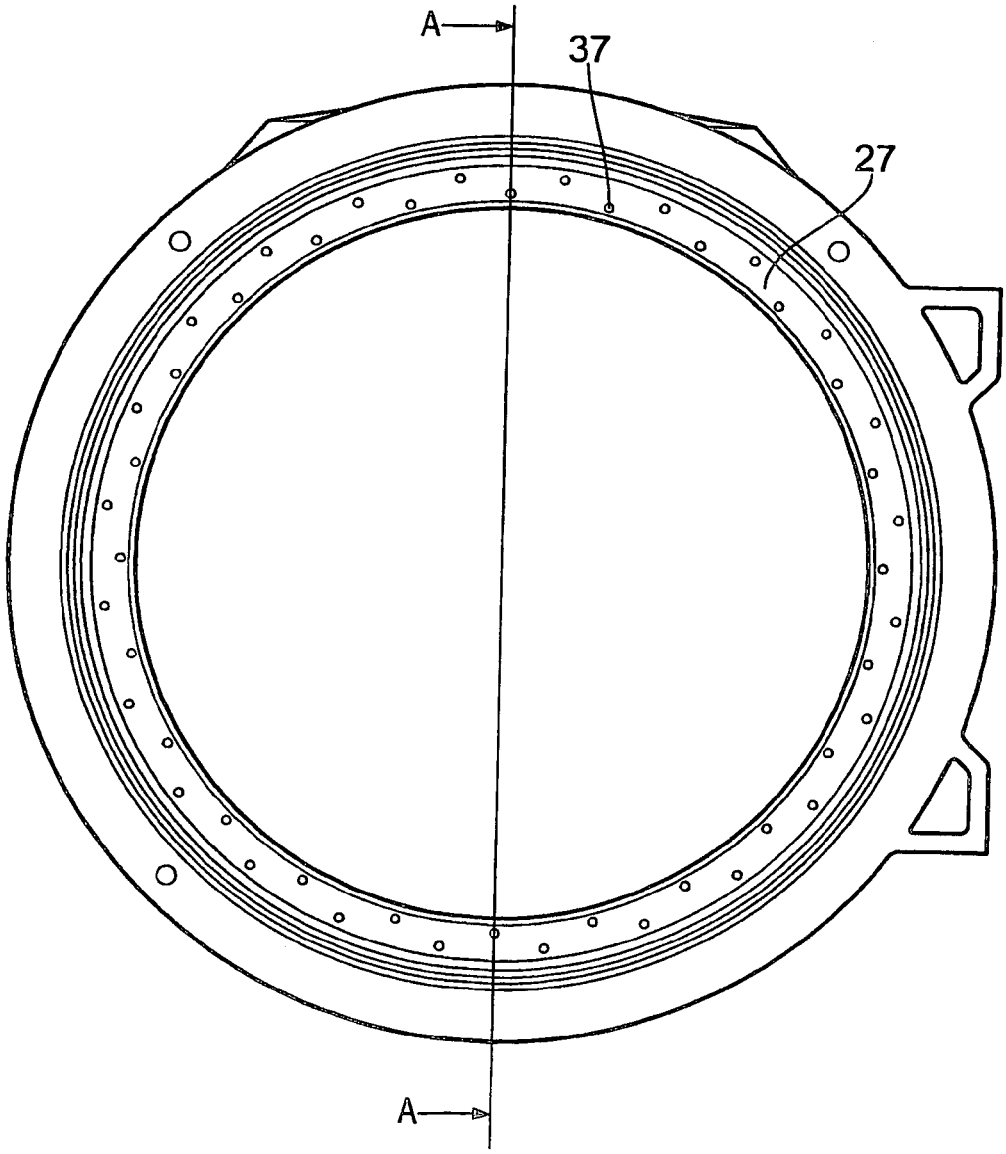
FIG. 4 is a front view of a tunnel element.
Figure 5:
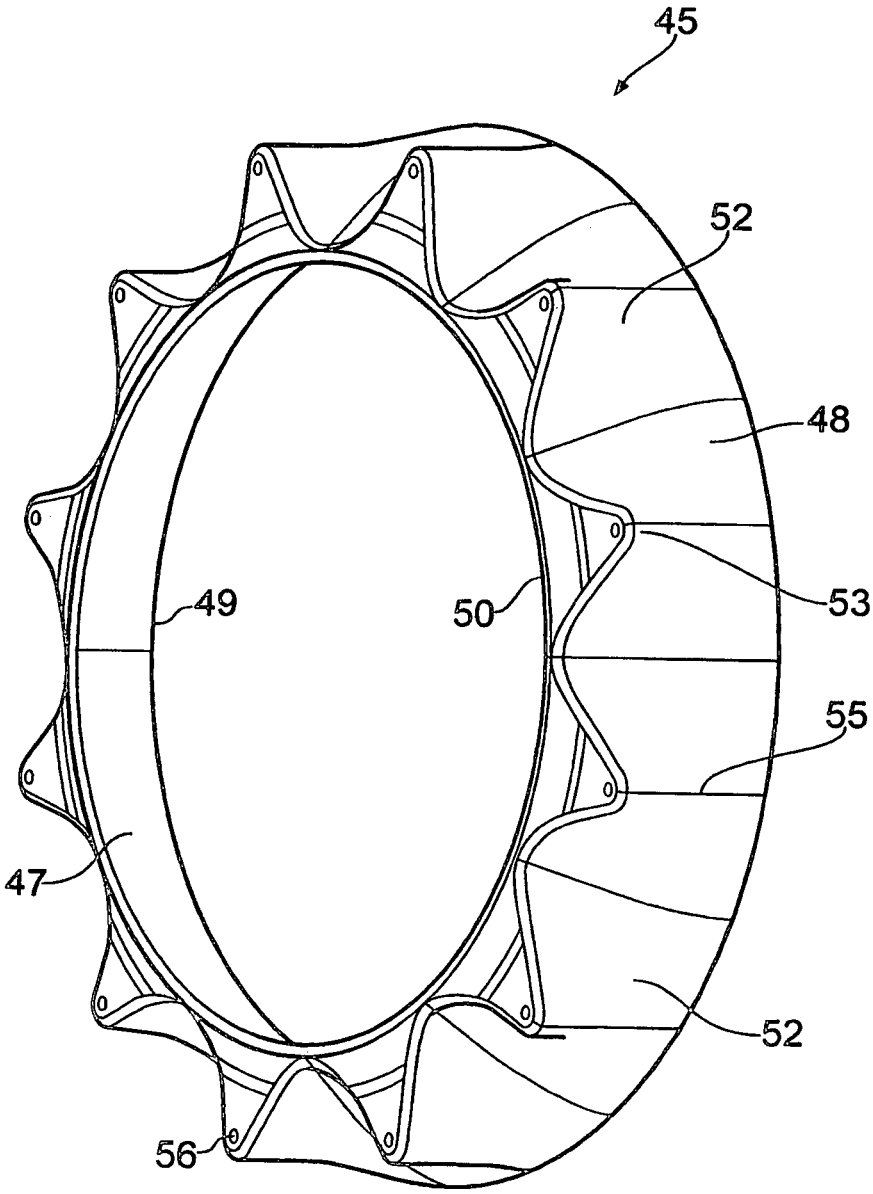
FIG. 5 is a perspective view of a tunnel inlet.
Figures 6, 7, 8:
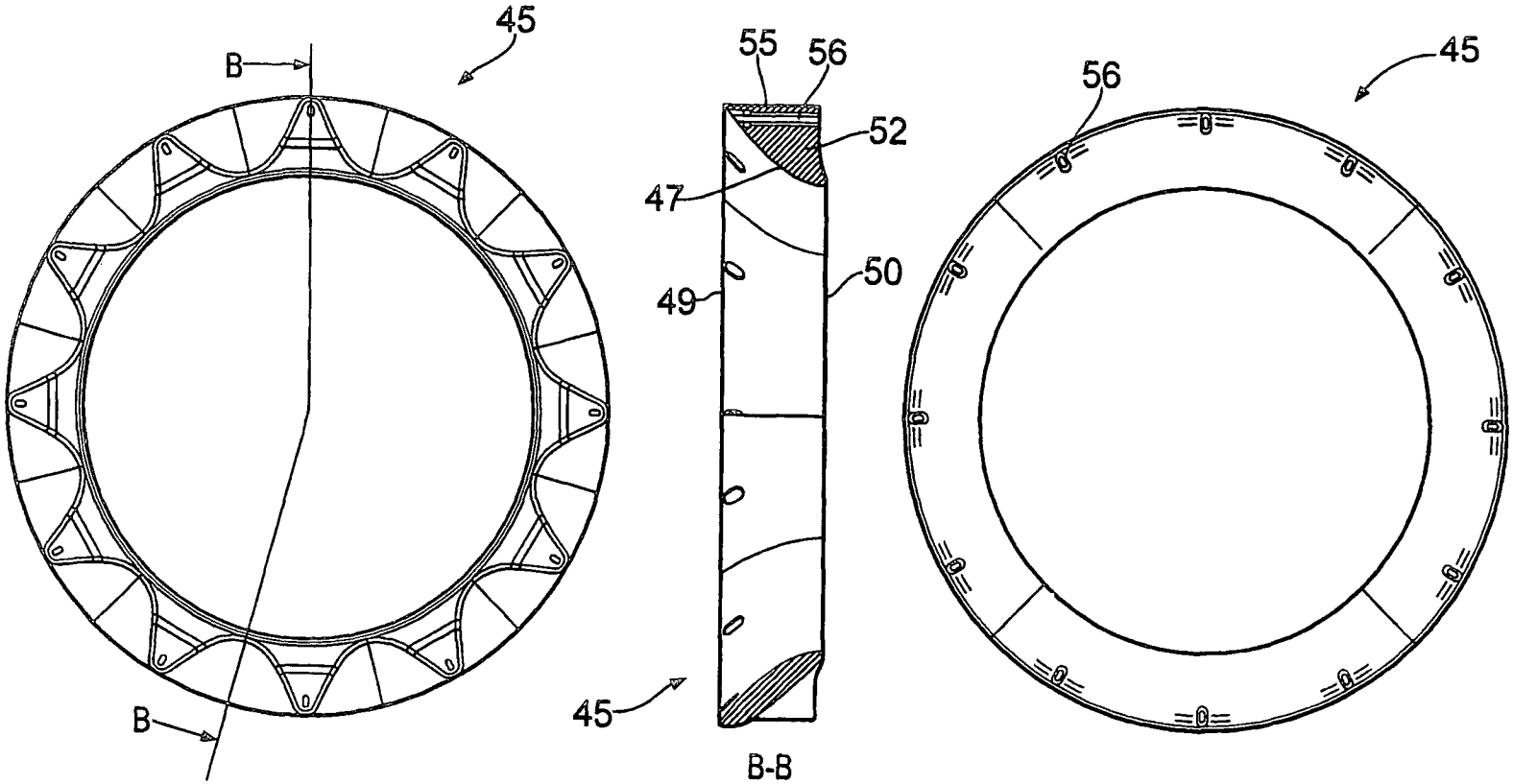
FIG. 6 is a rear view of a tunnel inlet.
FIG. 7 shows a section B-B as indicated in FIG. 6.
FIG. 8 is a front view of a tunnel inlet.

FIG. 1 shows a thruster unit according to the invention.

Described below is a single embodiment of the invention which must not be regarded as limiting for one or more embodiments of the present invention.

FIGS. 1-4 show a thruster unit 30 which is a part of a thruster that is intended to be used in the hull of a vessel. More specifically, the thruster is designed to be arranged in a through tunnel in the hull of the vessel. Optionally, the thruster may constitute the whole of the through tunnel in the vessel's hull.

The thruster consists of a thruster unit 12 and a tunnel element 14. The tunnel element 14 is arranged fixedly in the vessel's hull in such a way that it constitutes a part of the through tunnel, or if the through tunnel is short, the tunnel element 14 may possibly constitute the whole tunnel.

The thruster unit 12 comprises a propeller with propeller blades 34 that are attached to a propeller hub 32 and an inner propeller ring 40 at the outer edge 35 of the propeller blades. An outer propeller ring 41 surrounds the inner propeller ring 40. The inner propeller ring 40 is rotatably disposed in relation to the outer propeller ring 41. Another alternative is to construct the tunnel element 14 with a rotatable ring such that the thruster unit then comprises only one ring. This one ring comprises the first fastening device 16 and the outer edge 35 of the propeller blades is fastened to the inside of the ring.

Either the inner propeller ring 40 or the outer propeller ring 41 is further provided with a first fastening device 16 comprising a first fastening face 26. The tunnel element 14 is provided with a corresponding fastening device 17 comprising a second fastening face 27. The first fastening face 26 and the second fastening face 27 are designed in such a way that they can be brought into contact with each other and mounted together.

For this purpose, i.e., the mounting together of the first and the second fastening face, holes 36 are provided in the first fastening device and corresponding holes 37 are provided in the second fastening device 17. A fastening means such as bolts, screws or the like can then be used to mount the thruster unit 12 to the tunnel element 14. In this way, the thruster unit may easily be mounted and later, if necessary, demounted from the tunnel element 14.

It is also possible to provide the end of the through tunnel through which the thruster unit 12 is introduced into the tunnel element 14 with tunnel inlet 45. An example of such a tunnel inlet is shown in FIGS. 5-8.

The tunnel inlet 45 is configured with an inner wall 47 that partly faces in towards the centre axis of the tunnel inlet, an outer wall 48, an inner edge 50 which will rest against the tunnel element 14, the thruster unit 12 or the hull of the vessel when mounted, and an outer edge.

The inner wall 47 is configured such that the water that flows into the through tunnel in the vessel's hull will be given an optimally favourable flow pattern. The inner wall may have a curved shape when seen in a section taken in a section through the tunnel inlet 45 at right angles to the centre axis of the tunnel inlet, as can clearly be seen in FIG. 7.

The outer wall 48 is constructed with reinforcements 52 around the whole circumference of the tunnel inlet 45. In the embodiment shown in the figures, these reinforcements 52 constitute a corrugated reinforcement around the circumference of the tunnel element. The corrugated reinforcements 52 have wave crests 53 which form wave ridges 55 where the thickness of the tunnel element in a radial direction is greatest.

The reinforcements 52 may be provided with holes 56 so that the tunnel inlet 45 can be mounted to, and optionally later demounted from, the tunnel inlet 14 or the thruster unit 12 or optionally in the hull of the vessel with the aid of a fastening means such as bolts, screws or the like.

By means of this invention, where the tunnel element 14 and the thruster unit 12 are so constructed that the thruster unit can be introduced axially into the tunnel element 14, and where the tunnel element 14 and the thruster unit 12 are made with corresponding fastening devices 16, 17, the thruster unit 12 can be easily mounted and later optionally demounted from the tunnel element 14. In addition, a tunnel inlet 45, which is adapted to the individual thruster, can be mounted to and optionally demounted from the thruster or the vessel's hull so as to generate optimal conditions for the water flow into or out of the through tunnel in the vessel's hull.

Figure 9:
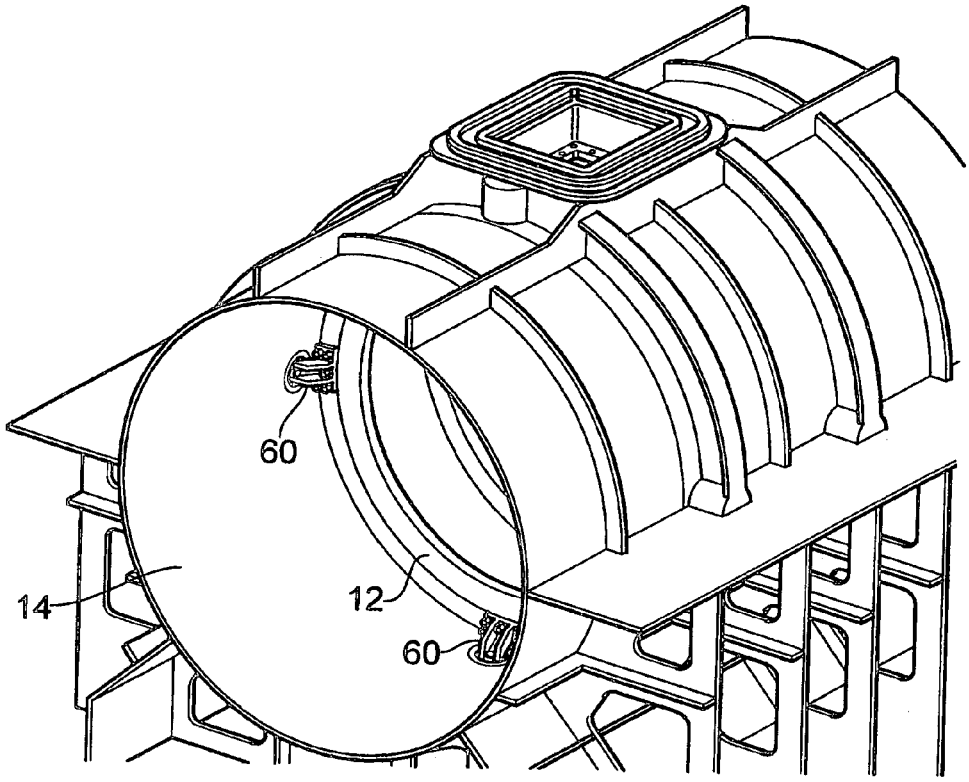
FIG. 9 is a view of an embodiment of the fastening devices in the tunnel element.
Figure 10:
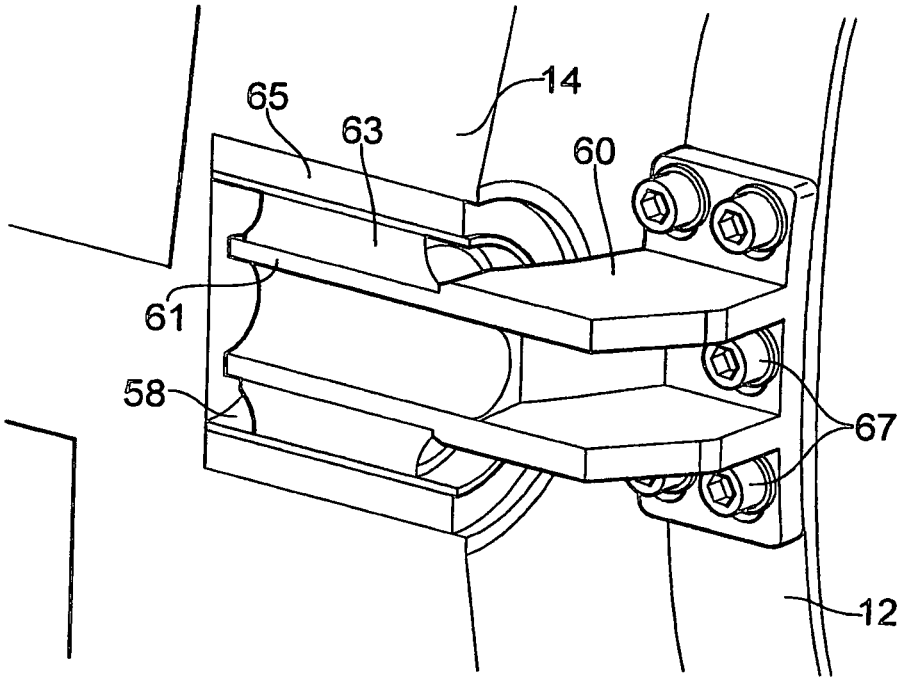
FIG. 10 is a view of an embodiment of the fastening devices when the thruster unit is mounted in the tunnel element.

FIGS. 9 and 10 show an alternative way of fastening the thruster unit 12 to the tunnel element 14. In FIG. 9, the tunnel element 14 is shown with brackets 60 mounted in cavities in the tunnel element 14. The brackets 60 are demountably fastened to the thruster unit 12, such as with the aid of bolts, screws or similar fastening means. It should be noted that only the part of the thruster unit 12 to which the bracket 60 is mounted is shown in FIG. 9.

FIG. 10 shows in more detail the bracket 60 and how the thruster unit 12 is fastened to the tunnel element 14. A cavity 58 is provided in the tunnel element 14. An annular support element 63 which may have varying rigidity may be arranged in the cavity 58. An annular casting 65 may be disposed between the annular support element 63 and the cavity 58. The bracket 60 is constructed with a projecting fastening member 61 which is arranged in the annular support element 63. The bracket 60 is further fastened to the thruster unit 12 by means of bolts 67. The thruster unit 12 can thus easily be mounted in the tunnel element 14 by passing the thruster unit in until it reaches the brackets 60 which are arranged in the tunnel element 14, and then fastening it to the brackets with the aid of bolts. If later it is necessary to demount the thruster unit for service or replacement, it is simply a question of removing the bolts 67 and passing the thruster unit 12 out through the tunnel element and the tunnel. It will not be necessary to go into dock to carry out such an operation, and compared to the prior art, where the thruster unit is an integral part of the motive power unit and extensive work must be carried out on the structure in order to be able to remove the thruster unit, this is a highly simplified design.

The invention claimed is:

1. A vessel comprising:

a hull and a thruster, wherein the thruster comprises at least one thruster unit and at least one tunnel element that includes at least a part of a through tunnel in the hull, wherein the at least one thruster unit and the at least one tunnel element comprise cooperating fastening devices for detachable fastening of the at least one thruster unit from the at least one tunnel element, the cooperating fastening devices comprising a plurality of cavities that are provided in the tunnel element, and a plurality of brackets comprising a projecting fastening member, wherein the at least one thruster unit comprises a propeller with propeller blades and an inner propeller ring surrounding the propeller blades with the propeller blades attached to the inner propeller ring, wherein the at least one thruster unit further comprises an outer propeller ring surrounding the inner propeller ring with the inner propeller ring rotatably disposed in relation to the outer propeller ring, wherein the fastening member of the brackets comprises a shape that is complementary to the cavities and are arranged in the cavities with the brackets demountably fastened to the outer propeller ring of the at least one thruster unit using one or more fastening means such that the at least one thruster unit is configured to be mounted in the tunnel element by passing the at least one thruster unit axially in through the tunnel until the at least one thruster unit reaches the brackets to fasten the at least one thruster unit to the brackets with the one or more fastening means and such that the at least one thruster unit is configured to be demounted from the brackets and passed axially out of the tunnel.

2. The vessel according to claim 1, wherein the cavity and the projecting fastening member are complementarily cylindrically shaped.

3. The vessel according to claim 2, wherein the cross-section of the cavity and the cross-section of the projecting fastening member have a circular, elliptical or polygonal form.

4. The vessel according to claim 1, wherein in the cavity is provided an annular support element that lies between the cavity and the projecting fastening member when the projecting fastening member is arranged in the cavity.

5. The vessel according to claim 4, wherein the annular support element is constructed with varying rigidity in the axial direction and/or radial direction of the support element.

6. The vessel according to claim 1, wherein the cavity is constructed with a flange or a ring that is arranged in or on the tunnel element.

7. The vessel according to claim 1, wherein the thruster comprises a tunnel inlet for the tunnel, wherein the tunnel inlet comprises an inner wall that faces towards the longitudinal centre axis of the tunnel inlet, an outer wall that faces away from the centre axis of the tunnel inlet, an outer edge that faces out from the hull, and an inner edge that faces in towards the hull of the vessel, wherein the tunnel inlet is adapted for demountable mounting, either to a tunnel element that, when mounted in the tunnel, includes at least a part of the tunnel, or on the at least one thruster unit that is demountably arranged in the tunnel element.

8. The vessel according to claim 7, wherein the tunnel inlet has an internal diameter $d_1$ at its outer edge and an internal diameter $d_2$ at its inner edge, where $d_1$ is greater than $d_2$.

9. The vessel according to claim 7, wherein the inner wall of the tunnel inlet between the outer edge and the inner edge has a curved shape.

10. The vessel according to claim 7, wherein arranged on the outer wall of the tunnel inlet is a reinforcement that runs around the whole circumference of the tunnel inlet, wherein the reinforcement is corrugated.

11. The vessel according to claim 10, wherein the wave crests of the corrugated reinforcement are formed with ridges that are essentially parallel to the longitudinal centre axis of the tunnel inlet.

12. The vessel according to claim 10, wherein arranged in the wave crests of the corrugated reinforcements are holes for fastening means so as to enable the tunnel inlet to be mounted demountably to the tunnel element or the at least one thruster unit.

13. A method for mounting and demounting at least one thruster unit that is a part of a thruster on a vessel, wherein the thruster comprises the at least one thruster unit and at least one tunnel element, and wherein the vessel comprises a hull with a through tunnel with the tunnel element at least partly including a part of the tunnel when the tunnel element is arranged in the hull, the at least one thruster unit comprising a propeller with propeller blades and an inner propeller ring surrounding the propeller blades with the propeller blades attached to the inner propeller ring, the at least one thrusters unit further comprising an outer propeller ring surrounding the inner propeller ring with the inner propeller ring rotatably disposed in relation to the outer propeller ring, wherein the method comprises:

arranging a plurality of brackets, each with a projecting fastening member, in corresponding cavities in the tunnel element before the at least one thruster unit is passed to the mounting point in the tunnel element, the projecting fastening member and corresponding cavity having a complementary shape;

passing the at least one thruster unit axially through the tunnel to the brackets in the tunnel element when the at least one thruster unit is mounted in the tunnel element;

mounting the brackets to the outer propeller ring of the at least one thruster unit with fastening means;

demounting the brackets in the tunnel element from the outer propeller ring of the at least one thruster unit when the at least one thruster unit is demounted from the tunnel element; and passing the at least one thruster unit axially out of the tunnel.

14. The method according to claim 13, further comprising:

arranging an annular support element in the cavity prior to the mounting of the at least one thruster unit to the tunnel element in such a way that the support element lies between the projecting fastening member and the inner wall of the cavity when the at least one thruster unit is mounted in the tunnel.

15. The method according to claim 13, further comprising:

arranging the cavity in a flange element or a ring element in the tunnel.

16. The method according to claim 13, wherein a tunnel inlet is mounted to the at least one thruster unit or the tunnel element after the at least one thruster unit has been introduced into and is fixedly mounted to the fastening means of the tunnel unit.

17. The method according to claim 13, wherein a tunnel inlet, that optionally is mounted on the at least one thruster unit or the tunnel element, is demounted before the thruster unit is demounted from the tunnel element and is passed out of the tunnel element.

* * * * *